US010370186B2

(12) United States Patent
Primm et al.

(10) Patent No.: US 10,370,186 B2
(45) Date of Patent: Aug. 6, 2019

(54) SUBSEA FLUID STORAGE SYSTEM

(71) Applicant: Oceaneering International, Inc., Houston, TX (US)

(72) Inventors: Benjamin Primm, Houston, TX (US); Christopher Leon, Cypress, TX (US); Earl Schultz, Spring, TX (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 15/702,796

(22) Filed: Sep. 13, 2017

(65) Prior Publication Data

US 2018/0072494 A1 Mar. 15, 2018

Related U.S. Application Data

(60) Provisional application No. 62/393,792, filed on Sep. 13, 2016.

(51) Int. Cl.

| | |
|---|---|
| ***B65D 90/32*** | (2006.01) |
| ***B63B 25/14*** | (2006.01) |
| ***B63G 8/00*** | (2006.01) |
| ***B65D 88/78*** | (2006.01) |
| ***B65D 88/60*** | (2006.01) |
| *B65D 90/50* | (2019.01) |

(52) U.S. Cl.

CPC ..... *B65D 90/32* (2013.01); *B63B 25/14* (2013.01); *B63G 8/001* (2013.01); *B65D 88/60* (2013.01); *B65D 88/78* (2013.01); *B63G 2008/005* (2013.01); *B65D 90/50* (2013.01)

(58) Field of Classification Search

CPC .. Y10T 137/2036; B65D 88/16; B65D 88/62; B63B 2025/022

USPC ..... 137/81.2; 405/210; 220/720, 721, 723

See application file for complete search history.

(56) References Cited

U.S. PATENT DOCUMENTS

| | | | | |
|---|---|---|---|---|
| 4,335,520 A * | 6/1982 | Wilson | E21B 47/02 33/312 |
| 2004/0055600 A1* | 3/2004 | Izuchukwu | F17C 1/02 128/205.15 |
| 2016/0023843 A1* | 1/2016 | Donahue | B65D 88/78 405/210 |

* cited by examiner

*Primary Examiner* — Sean D Andrish

(74) *Attorney, Agent, or Firm* — Maze IP Law, P.C.

(57) ABSTRACT

A subsea fluid storage system comprising a soft bladder disposed within a pressure balanced reservoir, a rotatable piston, and a piston rotator which rotates and twists the rotatable piston as it travels along a predetermined axis within the pressure balanced reservoir, predictably and repeatabley collapses the soft bladder when the rotating piston cooperatively travels about the piston rotator, twisting the soft bladder as the rotating piston moves along the predetermined axis, collapsing the bladder inward and thereby emptying the bladder of fluid within the bladder. The piston's rotation pulls the soft bladder away from the pressure balanced reservoir's interior, thereby preventing the bladder's binding or pinching the pressure balanced reservoir's interior. In configurations, fluid is allowed to enter the pressure balanced reservoir via a valve until a balance is achieved between an interior and an exterior of the pressure balanced reservoir.

19 Claims, 6 Drawing Sheets

SUBSEA FLUID STORAGE SYSTEM

RELATION TO PRIOR APPLICATIONS

This application claims priority from and through U.S. Application 62/393,792 titled "SUBSEA FLUID STORAGE SYSTEM" and filed on Sep. 13, 2016.

BACKGROUND OF THE INVENTION

Fluids are often required to be stored subsea or for use subsea. Often, however, a predictable and repeatable volume of such fluid is difficult to maintain and unwanted over-pressurization and/or under-pressurization of fluid in the fluid storage system can result.

FIGURES

The figures supplied herein illustrate various embodiments of the invention.

DESCRIPTION OF EXEMPLARY EMBODIMENTS

Figure 1:
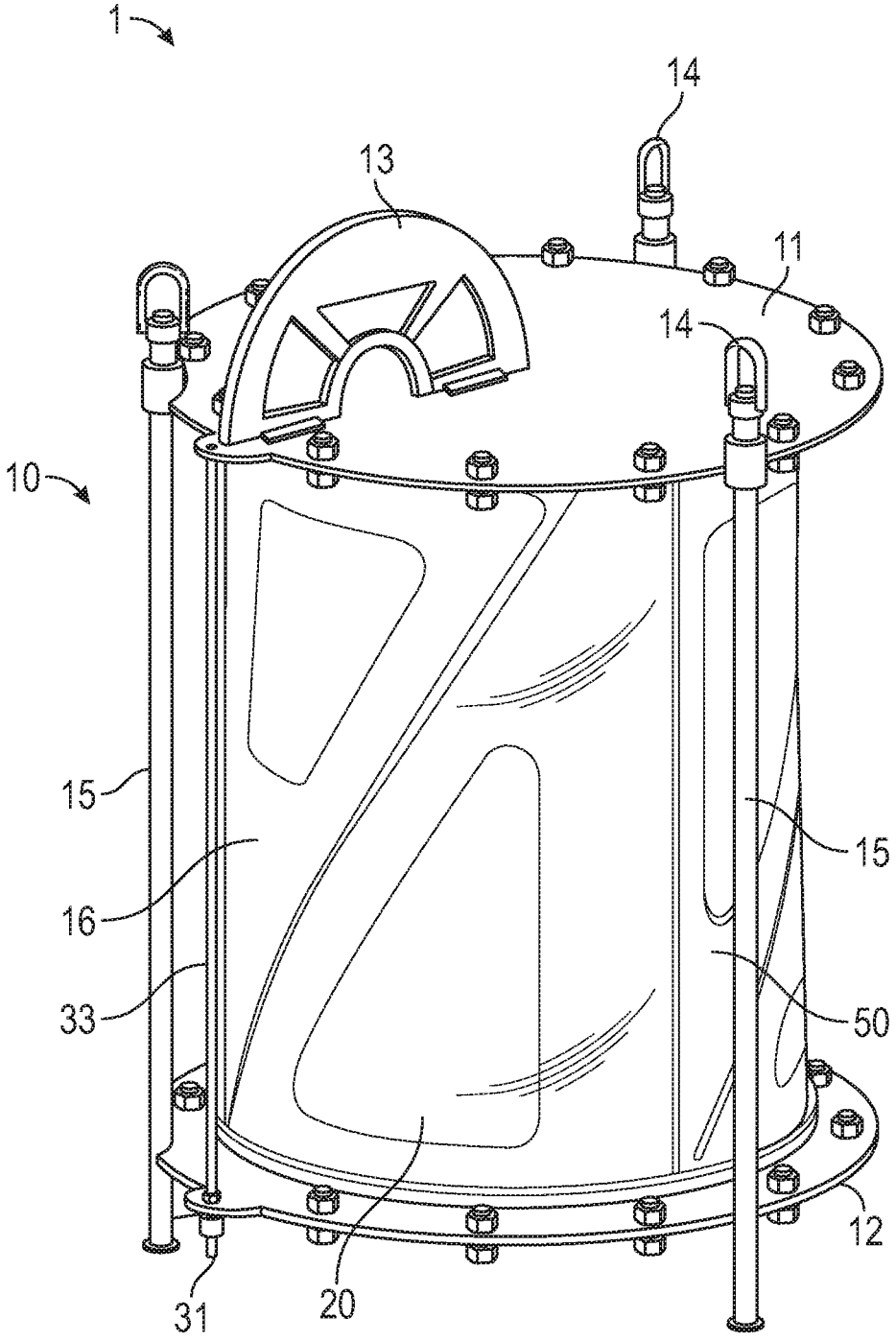
FIG. 1 is a view in partial perspective of an exemplary first embodiment of a subsea fluid storage system illustrating a sleeve and bladder.

Referring now to FIG. 1, subsea fluid storage system 1 comprises pressure balanced reservoir 10, soft bladder 20 disposed within pressure balanced reservoir 10, rotatable piston 30 disposed at least partially within pressure balanced reservoir 10; and piston rotator 50 disposed within pressure balanced reservoir 10.

In most embodiments, pressure balanced reservoir 10 comprises upper cover 11 and lower cover 12, where one or both of these covers may be a plate, a flange, or the like. Typically, upper cover 11 and lower cover 12 are rigid or otherwise substantially solid.

One or more support brackets 13 and one or more lifting eyes 14 may be connected to upper cover 11. Additionally, one or more supports 15 may be connected to upper cover 11 and/or lower cover 12. Lifting eye 14 may be connected or otherwise attached to support 15.

In addition, pressure balanced reservoir 10 may comprise a substantially tubular outer housing 16 disposed intermediate upper cover 11 and lower cover 12 in which soft bladder 20 and rotatable piston 30 are disposed.

Soft bladder 20 typically comprises a soft cylindrical collapsible bladder, e.g. a bladder comprising a suitable but collapsible/extendable material such as polyvinylidene fluoride. In most embodiments, the volume of soft bladder 20 is scalable to meet various application requirements as needed.

Rotatable piston 30 is typically in communication with or otherwise connected to top 21 (FIG. 3) of soft bladder 20 and configured to rotate axially, twisting soft bladder 20 as rotatable piston 30 travels along a predetermined axis within pressure balanced reservoir 10.

Piston rotator 50 is operatively in communication with rotatable piston 30 and operative to rotate rotatable piston 30 axially along the predetermined axis. Piston rotator 50 may comprise guide sleeve 51 (FIG. 5) which further comprises one or more sleeve channels 52 (FIG. 5) or housing channels 56 (not shown in the figures but similar to sleeve channels 52 except that they are integrated into outer housing 16) and rotatable piston 30 typically comprises a corresponding set of channel posts 35 (FIG. 4) adapted to slidingly fit inside sleeve channels 52 or housing channels 56.

Figure 4:
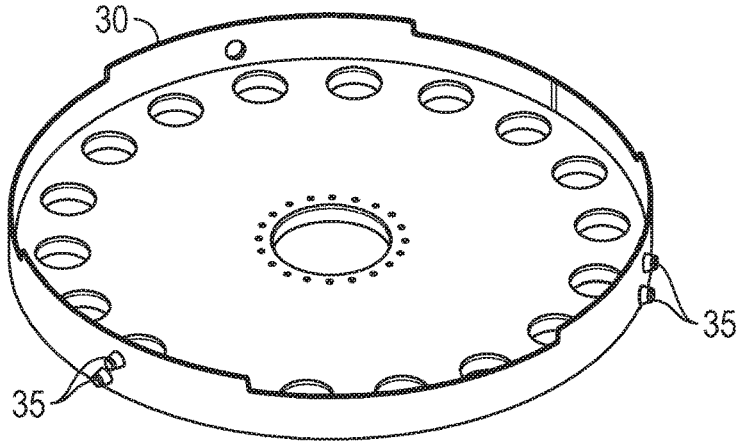
FIG. 4 is a view in partial perspective of an exemplary first embodiment of a subsea fluid storage system illustrating the piston.
Figure 8:
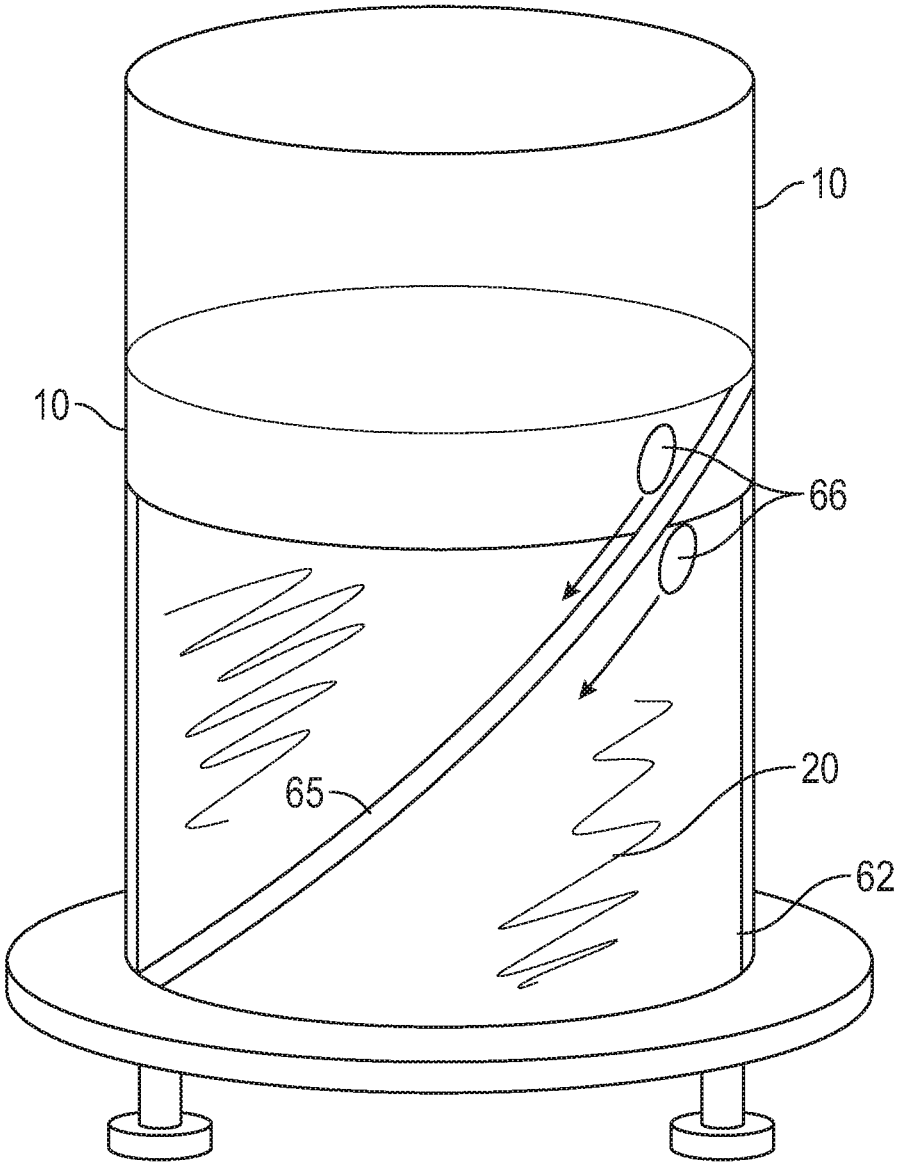
FIG. 8 is a view in partial perspective of an exemplary third embodiment of a subsea fluid storage system.

In embodiments where substantially tubular outer housing 16 is present, guide sleeve 51, if used, is disposed within substantially tubular outer housing 16 and is typically in contact with rotatable piston 30. Alternatively, piston rotator 50 may comprise one or more tubes 65 (FIG. 8) comprising a helical shape and a predetermined set of rollers 66 (FIG. 8), where rollers 66 are typically integrated into or otherwise a part of rotatable piston 30 (FIG. 4). In these embodiments, rotatable piston 30 is still present but one or more rollers 66, each of which may comprise a roller bearing, rides on tube 65, allow tube 65 to replace sleeve 51.

As can be seen, if used each of guide channels 65, housing channels 56, or tubes 65 is operative to rotate and twist rotatable piston 30 as rotatable piston 30 travels along the predetermined axis within substantially tubular outer housing 16, such as by using channel posts 35 (FIG. 4) in guide channels 65 or housing channels 56 or by using rollers 66 and tubes 65.

In certain embodiments, one or more valves 53 are present and selected to have appropriate properties to allow pressure balanced reservoir 10 to be isolated in the event of a bladder leak.

In certain embodiments, plumb bob 31 (FIG. 1) is present and operatively connected to rotatable piston 30 such as via flexible connector 32 disposed intermediate plumb bob 31 and rotatable piston 30. Flexible connector 32 may comprise a wire.

Generally, subsea fluid storage system 1 may be stand-alone or integrated into a remotely operated vehicle skid, a frame, or configured as a farm of similar tanks.

In the operation of exemplary embodiments, fluid such as sea water is allowed to enter pressure balanced reservoir 10 of subsea fluid storage system 1, which is as described above, allowing a balance between an interior and an exterior of soft bladder 20 via a predictable and repeatable collapse of soft bladder 20, which may be accomplished by using rotatable piston 30 to twist soft bladder 20 as rotatable piston 30 moves along and rotates about the predetermined axis in such a manner as to collapse soft bladder 20 inward, thereby emptying soft bladder 20 of fluid within soft bladder 20 as rotation of rotatable piston 30 pulls soft bladder 20 away from an interior of pressure balanced reservoir 10.

Typically, rotatable piston 30, which is connected to top 21 (FIG. 3) of soft bladder 20, exerts positive pressure on soft bladder 20, collapsing soft bladder 20 as it is emptied. Rotation of rotatable piston 30 collapses soft bladder 20 inward, pulling the material of soft bladder 20 away from the walls of pressure balanced reservoir 10 and preventing binding or pinching with respect to the interior of pressure balanced reservoir 10. This further serves to help prevent puckering and potential damage to soft bladder 20 and allow for more complete removal of the fluid. Further, this may also help ensure correct operation of level sensor 33.

Figure 5:
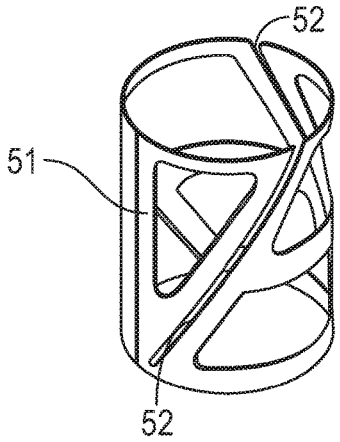
FIG. 5 is a view in partial perspective of an exemplary first embodiment of a subsea fluid storage system illustrating the sleeve.

By way of example and not limitation, where guide sleeve 51 (FIG. 5) is present and in contact with rotatable piston 30, guide sleeve 51 may be used to rotate and twist rotatable piston 30 as rotatable piston 30 travels along the predetermined axis within pressure balanced reservoir 10 by constraining channel posts 35 (FIG. 3) to travel within sleeve channels 52 (FIG. 5). Fluid may be allowed to enter or reenter pressure balanced reservoir 10 via one or more valves 54 until a desired balance is achieved between an interior and an exterior of pressure balanced reservoir 10.

Figure 6:
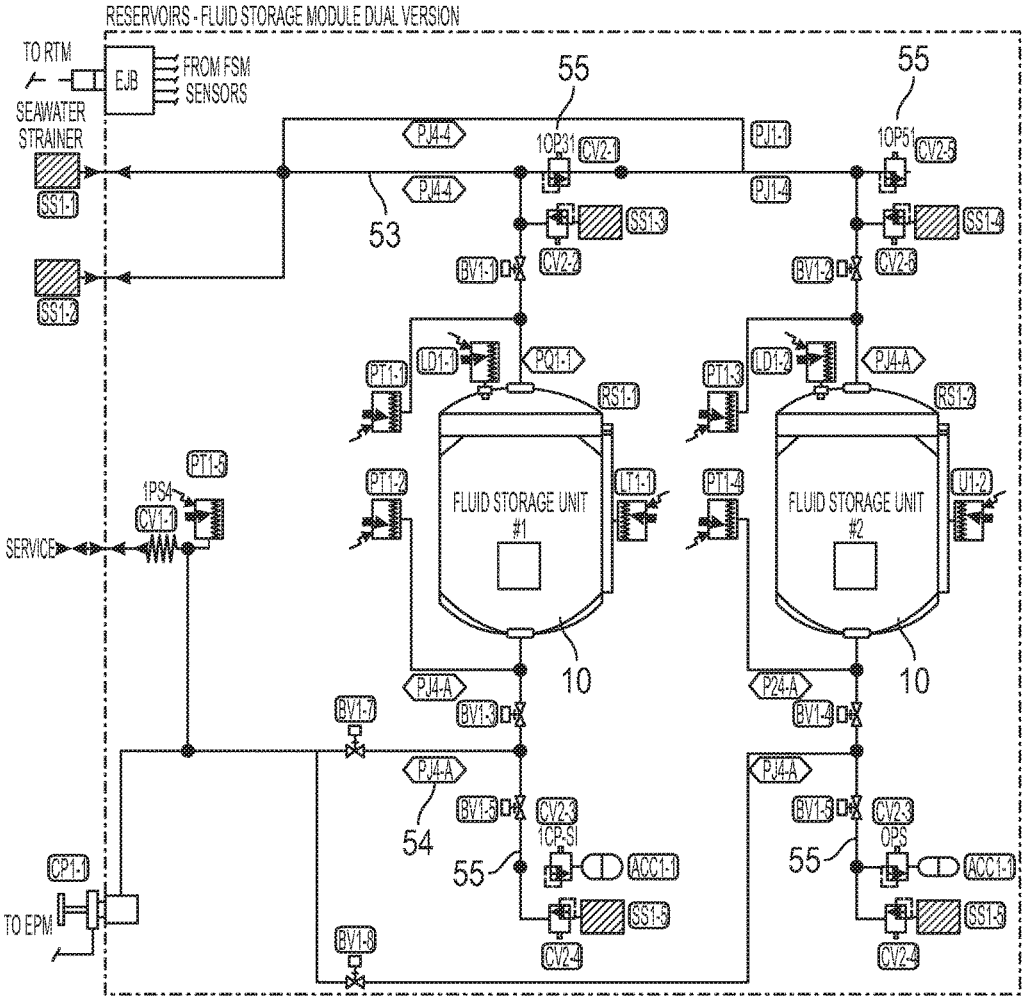
FIG. 6 is a schematic view of an exemplary subsea fluid storage system circuit.

Referring generally to FIG. 6, in embodiments where valve 54 is present, a fluid circuit may be controlled using valve 54, thereby allowing pressure balanced reservoir 10 to be isolated in the event of a bladder leak. In addition, one or more pressure relief devices 55 may be present and used to protect against over- or under-pressurization.

Figure 2:
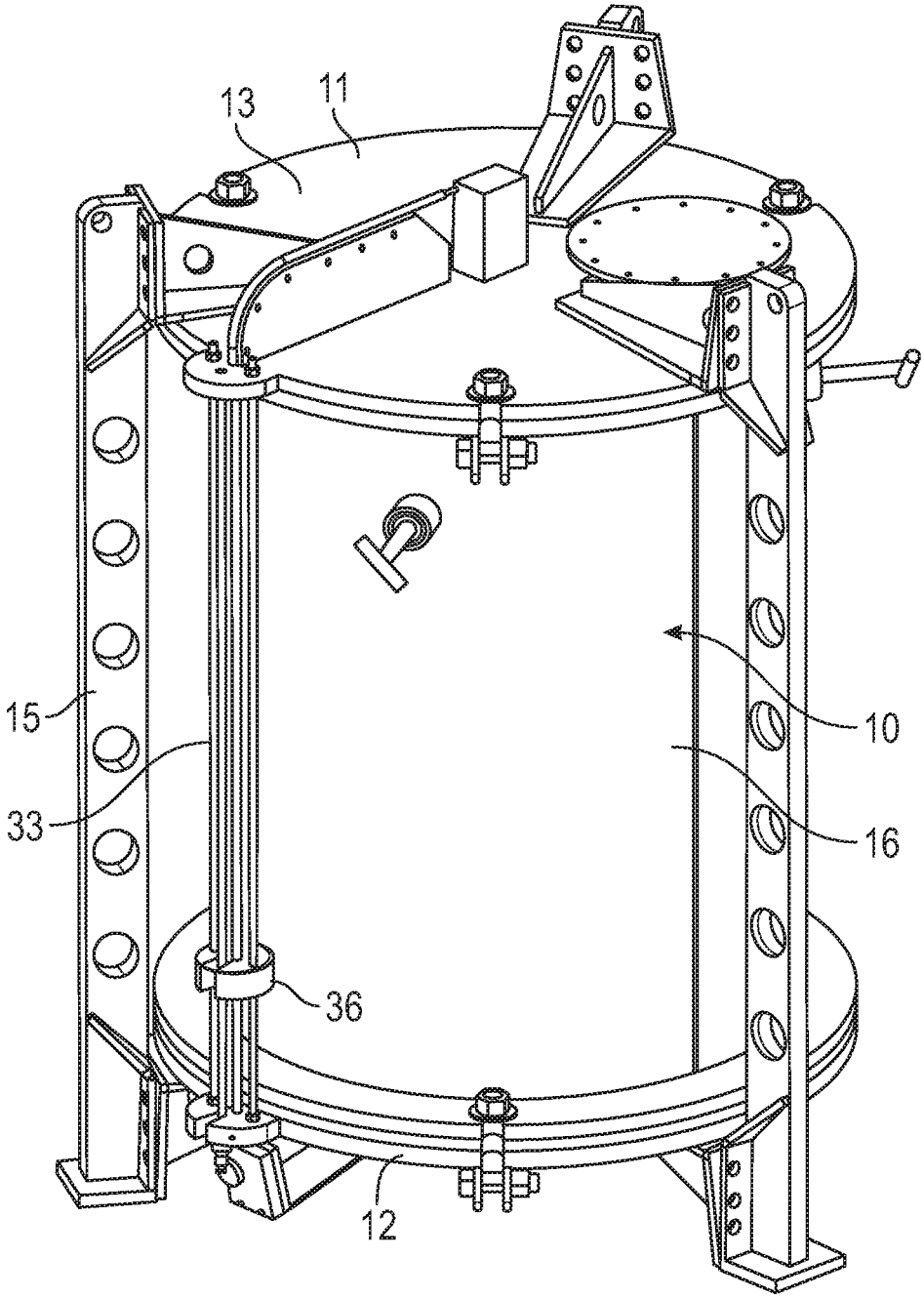
FIG. 2 is a view in partial perspective of the exemplary first embodiment of the subsea fluid storage system.
Figure 3:
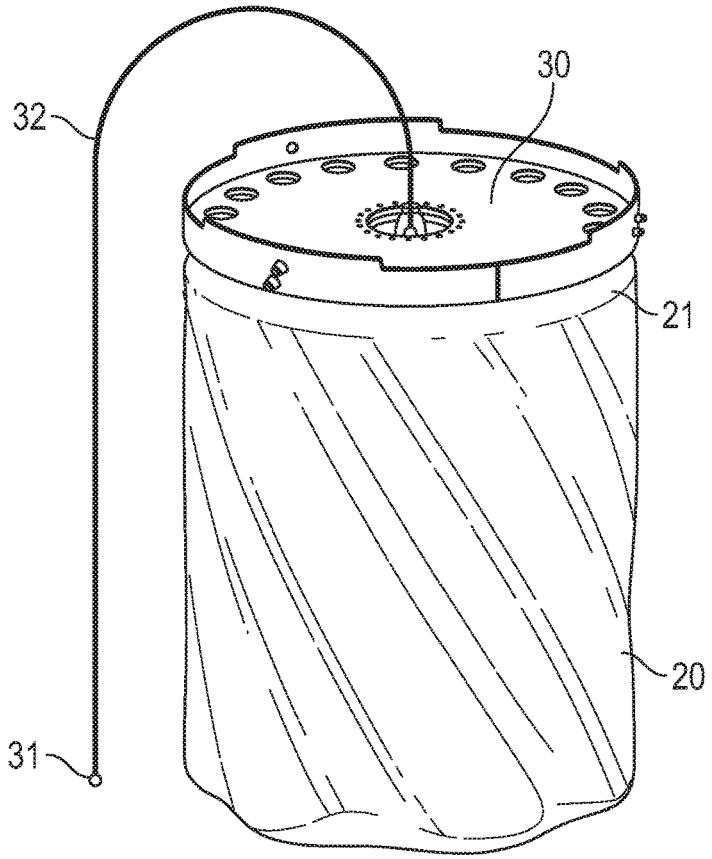
FIG. 3 is a view in partial perspective of an exemplary bladder and piston.

In embodiments, subsea fluid storage system 1 further comprises one or more level sensors 33 (FIGS. 1, 2). In these embodiments, level sensor 33 may be used to monitor displacement of rotatable piston 30 relative upper cover 11 (FIGS. 1, 2), lower cover 12 (FIGS. 1, 2), or both to obtain a measurement of the displacement of rotatable piston 30 relative to upper cover 11, lower cover 12, or both. The measured displacement may then be used to calculate a current volume of soft bladder 20 (FIG. 3).

Figure 7:
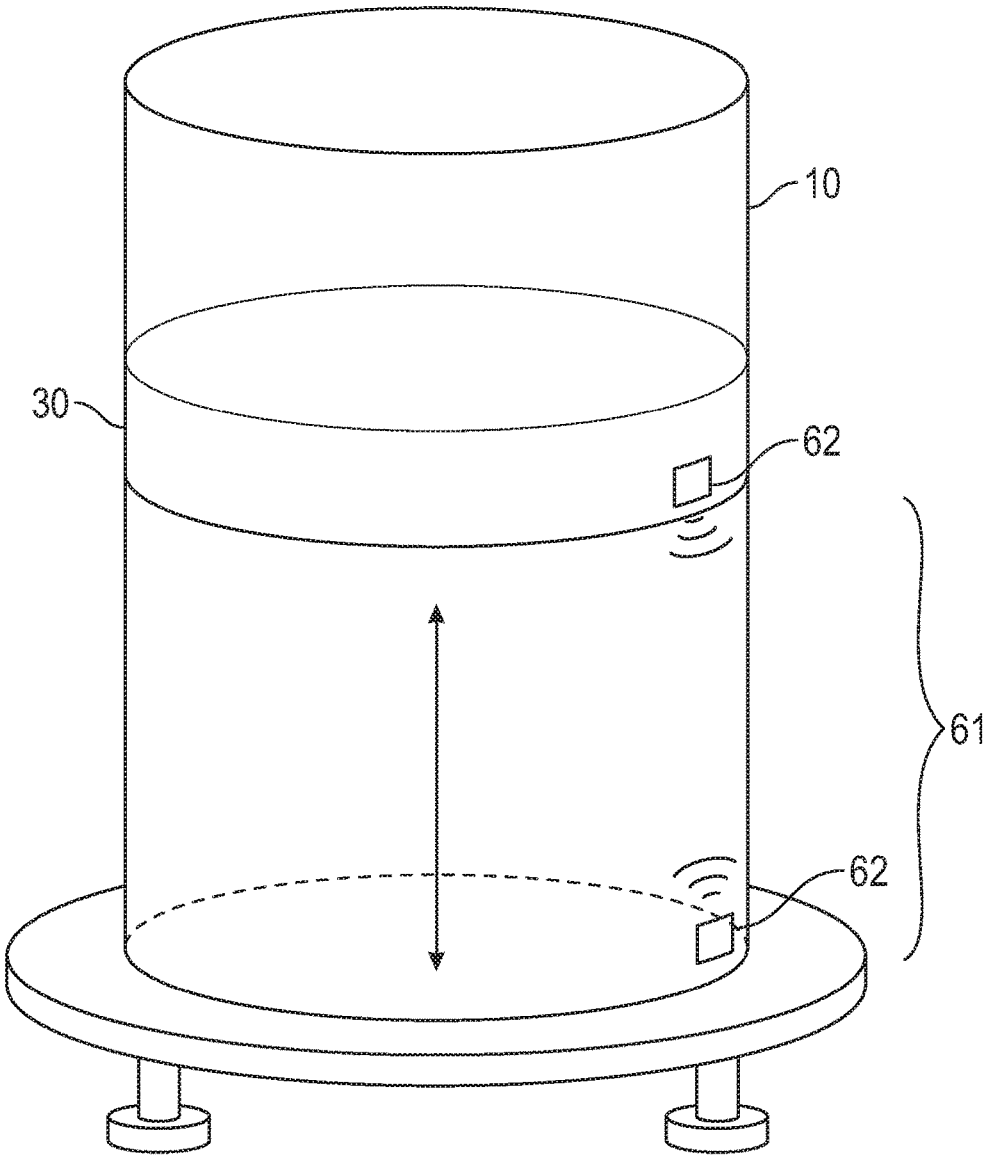
FIG. 7 is a view in partial perspective of an exemplary second embodiment of a subsea fluid storage system.

As described above, plumb bob 31 (FIG. 1), which may be weighted, may be connected to rotatable piston 30 via flexible connector 32 (FIG. 1) and used to provide a visual indication of fluid level within soft bladder 20 such as via a sight tube or the like. Additionally, one or more sensors 33 (FIG. 2) may be positioned proximate plumb bob 31 to detect a position of plumb bob 31 such as via magnets 36 (FIG. 2), e.g. using Hall effect sensors or the like.

Where subsea fluid storage system 1 further comprises a piston sensor 61 (FIG. 7) and one or more proximity switches 62 (FIG. 7) located near an predetermined stroke extent, e.g. near an end of stroke, piston sensor 61 and proximity switches 62 may be used to provide a signal useful for a fluid flow cutoff, e.g. when 30 piston is proximate proximity switch 62, thus helping to prevent pulling an undersired vacuum on soft bladder 20.

In certain embodiments, one or more subsea fluid storage systems 1 may be disposed in a first orientation to allow for gravity fed fluids whereby weight placed on top of soft bladder 20 forces rotatable piston 30 down, i.e. collapsing soft bladder 20, as fluid is drawn and disposed in second orientation to allow for buoyancy fed fluids whereby rotatable piston 30 provides an upward buoyant force on fluid which is less dense than the surrounding environment.

One or more flowmeters (not shown in the figures) may be present and operatively in fluid communication with subsea fluid storage system 1. These flowmeters may be used to totalize fluid flow and infer volume via tracking. For example, fluid inflow should equal fluid outflow and/or tracking fluid discharge where a line out from soft bladder 20 should equal seawater inflow. As a secondary system, these flowmeters may provide ability to totalize flow and infer volume via tracking seawater inlet (line into tank) where inflow should equal fluid outflow and/or tracking fluid discharge where line out from bladder should equal seawater inflow.

In certain embodiments a tank system which incorporates subsea fluid storage system 1 may include protection against over or under pressurization via relief valves and/or otherwise comprise protection against over or under pressurization via relief valves. In certain configurations the tank system may also include leak detection sensors to look for presence of fluids outside of soft bladder 30 in various locations of the tank, e.g. some fluids have lighter density than water, sensor to be located at top of tank. Tank location may be modified to promote this, e.g. coned section at the top or bottom of the tank.

The foregoing disclosure and description of the inventions are illustrative and explanatory. Various changes in the size, shape, and materials, as well as in the details of the illustrative construction and/or an illustrative method may be made without departing from the spirit of the invention.

The invention claimed is:

1. A subsea fluid storage system suitable for use subsea, comprising:

a. a pressure balanced reservoir;

b. a soft bladder disposed within the pressure balanced reservoir;

c. a rotatable piston disposed at least partially within the pressure balanced reservoir, the rotatable piston in communication with a top of the soft bladder, the rotatable piston configured to axially rotate and twist the soft bladder as the rotatable piston travels along a predetermined axis within the pressure balanced reservoir; and d. a piston rotator disposed within the pressure balanced reservoir, the piston rotator operatively in communication with the rotatable piston and operative to axially rotate the rotatable piston along the predetermined axis.

2. The subsea fluid storage system suitable for use subsea of claim 1, wherein the soft bladder comprises a soft, cylindrical, collapsible bladder.

3. The subsea fluid storage system suitable for use subsea of claim 1, further comprising a valve operative to allow the pressure balanced reservoir to be isolated in the event of a leak from the soft bladder.

4. The subsea fluid storage system suitable for use subsea of claim 1, wherein the volume of the soft bladder is scalable.

5. The subsea fluid storage system suitable for use subsea of claim 4, wherein the piston rotator is operative to rotate and twist the rotatable piston as the rotatable piston travels along the predetermined axis within the substantially tubular outer housing, the piston rotator comprising one of:

a. a guide sleeve, the guide sleeve comprising a sleeve channel and the rotatable piston further comprising a channel post adapted to slidingly fit inside the sleeve channel;

b. a housing channel disposed about an interior of the pressure balanced reservoir, the rotatable piston further comprising a channel post adapted to slidingly fit inside the housing channel; or c. a tube comprising a helical shape and a predetermined set of rollers disposed about an outer portion of the rotatable piston, the rollers configured to engage against the tube.

6. The subsea fluid storage system suitable for use subsea of claim 1, further comprising a plumb bob operatively connected to the rotatable piston.

7. The subsea fluid storage system suitable for use subsea of claim 6, further comprising a flexible connector disposed intermediate the plumb bob and the rotatable piston.

8. The subsea fluid storage system suitable for use subsea of claim 7, wherein the flexible connector comprises a wire.

9. The subsea fluid storage system suitable for use subsea of claim 1, wherein the pressure balanced reservoir comprises an upper cover and a lower cover.

10. The subsea fluid storage system suitable for use subsea of claim 9, wherein the upper cover and the lower cover comprise a substantially solid flange.

11. The subsea fluid storage system suitable for use subsea of claim 9, further comprising:

a. a support bracket connected to the upper cover; and b. a lifting eye connected to the upper cover.

12. The subsea fluid storage system suitable for use subsea of claim 9, further comprising a support connected to the upper cover and to the lower cover.

13. The subsea fluid storage system suitable for use subsea of claim 12, further comprising a lifting eye connected to the support.

14. The subsea fluid storage system suitable for use subsea of claim 1, wherein the pressure balanced reservoir further comprises an upper cover, a lower cover, and a substantially tubular outer housing disposed intermediate the upper cover and the lower cover in which the soft bladder and the rotatable piston are disposed.

15. A method of allowing a predictable and repeatable collapse of a soft bladder of a subsea fluid storage system suitable for use subsea and disposed subsea which comprises the soft bladder disposed within a pressure balanced reservoir, a top of the soft bladder in communication with a rotatable piston disposed at least partially within the pressure balanced reservoir, and a piston rotator operative to rotate and twist the rotatable piston and the soft bladder as the rotatable piston travels along a predetermined axis within the pressure balanced reservoir, the method comprising:

a. allowing the piston rotator to cooperatively constrain travel of the rotating piston and thereby twist the soft bladder as the rotating piston moves along the predetermined axis in such a manner as to collapse the soft bladder inward, thereby emptying the soft bladder of fluid within the soft bladder, the rotation of the rotatable piston pulling the soft bladder away from an interior of the pressure balanced reservoir and thereby preventing binding or pinching of the soft bladder with respect to the interior of the pressure balanced reservoir; and b. allowing fluid to enter the pressure balanced reservoir until a balance is achieved between the interior and an exterior of the pressure balanced reservoir.

16. The method of claim 15, the system further comprising a valve, the method further comprising controlling a fluid circuit which incorporates the subsea fluid storage system by using the valve to control allowing the fluid to enter the pressure balanced reservoir until the balance is achieved between the interior and the exterior of the pressure balanced reservoir, therefore allowing the pressure balanced reservoir to be isolated if there is a bladder leak.

17. The method of claim 16, further comprising using a pressure relief device to protect against over-pressurization or under-pressurization of fluid in the pressure balanced reservoir.

18. The method of claim 15, the subsea fluid storage system further comprising a level sensor and the pressure balanced reservoir further comprising an upper cover and a lower cover, the method further comprising:

a. using the level sensor to monitor a displacement of the rotatable piston relative to the upper cover or the lower cover;

b. obtaining a measurement of the displacement of the rotatable piston relative to the upper or lower cover; and c. using the measurement to calculate a current volume of the soft bladder.

19. The method of claim 15, further comprising:

a. disposing the subsea fluid storage system in a first orientation to allow for gravity fed fluids whereby weight placed on the top of the soft bladder forces the rotatable piston down as fluid is drawn; and b. disposing the subsea fluid storage system in second orientation to allow for buoyancy fed fluids whereby the rotatable piston provides an upward buoyant force on fluid which is less dense than fluid in an environment surrounding the subsea fluid storage system.

* * * * *